United States Patent [19]

Shellenberger

[11] Patent Number: 4,887,959

[45] Date of Patent: Dec. 19, 1989

[54] GAS FURNACE WITH IMPROVED IGNITION

[75] Inventor: Timothy J. Shellenberger, Fort Smith, Ark.

[73] Assignee: Rheem Manufacturing Company, New York, N.Y.

[21] Appl. No.: 273,363

[22] Filed: Nov. 17, 1988

[51] Int. Cl.[4] ..... F23Q 9/08

[52] U.S. Cl. ..... 431/46; 431/51; 431/286

[58] Field of Search ..... 431/67, 6, 51, 43, 46, 431/286, 192

[56] References Cited

U.S. PATENT DOCUMENTS

| | | | |
|---|---|---|---|
| 2,286,610 | 6/1942 | Focke et al. | 431/192 |
| 2,761,502 | 9/1956 | Hoff et al. | 161/9 |
| 2,870,835 | 1/1959 | Lundgren | 161/9 |
| 2,983,314 | 5/1961 | Geldhof et al. | 158/125 |
| 3,476,491 | 11/1969 | Pipes et al. | 431/46 |
| 3,617,159 | 11/1971 | Arndt | 431/6 |
| 3,622,257 | 11/1971 | Hein et al. | 431/43 |
| 3,842,319 | 10/1974 | Perl | 219/260 |
| 4,147,496 | 4/1979 | Oikawa | 431/43 |
| 4,197,082 | 4/1980 | Matthews | 431/25 |
| 4,475,029 | 10/1984 | Yoshida et al. | 219/260 |

*Primary Examiner*—Carroll B. Dority

*Attorney, Agent, or Firm*—Hubbard, Thurman, Turner & Tucker

[57] ABSTRACT

A furnace employing a plurality of spaced burners, a carryover tube passing adjacent the burners, a hot surface igniter at one end of the carryover tube, a flame sensor at the other end of the carryover tube and an ignition control for controlling actuation of the hot surface igniter and the flow of combustible gas to the carryover tube and main burners, the ignition control being responsive to the flame sensor.

8 Claims, 1 Drawing Sheet

GAS FURNACE WITH IMPROVED IGNITION

BACKGROUND OF THE INVENTION

This invention relates to gas furnaces and, in particular, to gas furnaces employing a plurality of main burners and a carryover tube for providing a flame for igniting these burners.

In one type of gas furnace employing a carryover tube, a spark igniter is disposed at a first end of the carryover tube and a flame sensor is disposed at a second end of the tube. Upon a call for heat from the thermostat of the furnace, the furnace ignition control causes a combustible gas to be coupled to the carryover tube. At this time, the control also causes actuation of the spark igniter, which then ignites the gas resulting in a flame at the first end of the tube. This flame then propagates to the second end of the carryover tube and is sensed by the flame sensor. The flame sensor reports this condition to the ignition control and, in response, the control causes combustible gas to be simultaneously coupled to the main burners. The flame from the carryover tube then ignites this gas and the burners are thereby simultaneously ignited to produce the heating flame for the furnace.

Because the above type furnaces employ spark igniters, they are inherently susceptible to spark gap position. Furthermore, the use of a spark results in a comparably high density energy source in a small area, which can be promotive of an explosion.

Another type of furnace utilizing a carryover tube, employs a hot surface igniter such as, for example, a silicon carbide igniter. The use of a hot surface igniter is advantageous, since this type of igniter has a low susceptibility to misalignment, a large surface area and a high surface energy which promotes smooth lighting. In this type of furnace, the carryover tube and the main burners are both initially supplied gas simultaneously. As a result, igniting of the carryover tube by the igniter causes direct ignition, i.e., substantially simultaneous ignition of the carryover tube and burners. Because of this, the furnace is required to also perform a delayed ignition test which is designed to satisfy ANSI standards Z21.47 and Z21.64.

In order to carry out such test, it is typical for the furnace to utilize a so called "step" gas valve for supplying gas to the burners and the carryover tube. This valve allows for simultaneous ignition of the carryover tube and main burners at an initially reduced pressure (e.g., 50 percent of normal operating pressure) and then the valve steps to the normal operating pressure in a short period of time, typically six to ten seconds. As a result of the reduced pressure at initial ignition, the potential for concussion is reduced in the event of delayed ignition.

The use of "step" gas valves, however, is disadvantageous, since they are costly, large in size and have a relatively great number of parts. Furthermore, they are less desirable in the event a furnace must be converted from natural gas to liquid propane. In such case, step valves, due to their construction, are not easily modified and usually the entire valve must be changed. This drives up the cost of the conversion kit as compared to furnaces which employ standard snap open or slow open valves which are more easily converted.

It is, therefore, an object of the present invention to provide a gas furnace which overcomes the above-mentioned disadvantages.

It is a further object of the present invention to provide a gas furnace which has less potential for delayed ignition.

It is yet a further object of the present invention to provide a gas furnace which can be converted from natural gas to liquid propane in a cost effective manner.

It is a further object of the present invention to provide a gas furnace which is adapted to utilize more cost effective gas valves.

SUMMARY OF THE INVENTION

In accordance with the principles of the present invention, the above and other objectives are realized in a gas furnace utilizing a plurality of main burners in combination with a carryover tube having a tube section which passes adjacent each of the main burners. A hot surface igniter for igniting the gas in the carryover tube is situated at a first end of the tube section and a flame sensor is disposed at a second end of the section. An ignition control is responsive to the flame sensor and controls actuation of the hot surface igniter as well as a valve unit provided for delivering gas to the main burners and the carryover tube.

The ignition control actuates the igniter so that it heats to a temperature sufficient to ignite the combustible gas being used. The unit also addresses the valve unit causing it to provide gas to the carryover tube. The heated igniter causes ignition of this gas through an aperture at the first end of the tube section. Flame then progesses to an aperture at the second end of the tube section and is detected by the flame sensor. The sensor reports this fact to the control unit which then causes the valve unit to now allow gas to pass to the main burners. This gas is made available at apertures in the main burners and is ignited by the flame from the apertures of the carryover tube to produce the desired heating flame at the main burners.

By using the combination of a carryover tube, a hot surface igniter and a flame sensor in the furnace of the invention, the potential for delayed ignition is reduced as well as the need for complicated step valves. The apparatus is thus both safer and more cost effective.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
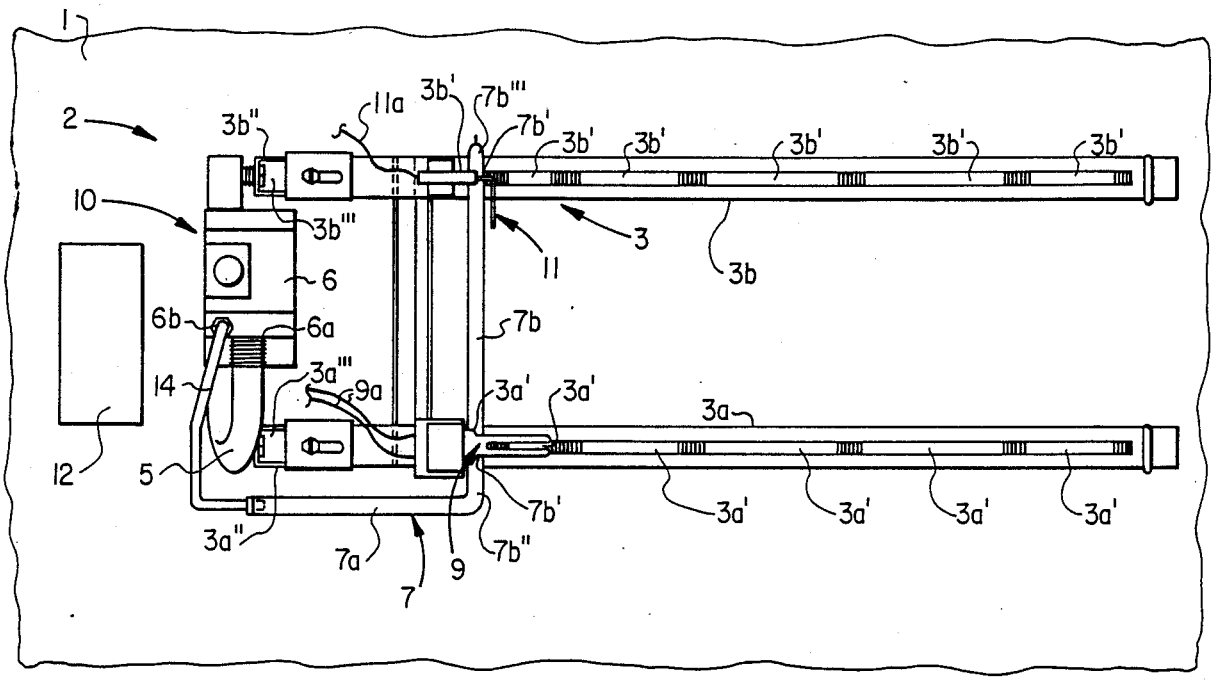
FIG. 1 shows, in schematic, a top plan view of a furnace in accordance with the principles of the present invention.

FIG. 1 shows a furnace 1 including an ignition and burner assembly 2 in accordance with the principles of the present invention. In FIG. 1, only the assembly 2 has been illustrated, since the other elements forming the furnace 1 are conventional and well known to the person of skill in the art of furnace design.

As shown, the ignition and burner assembly 2 comprises a burner unit 3 formed from elongated, tubular burners 3*a* and 3*b*. The burners 3*a* and 3*b* are transversely spaced and are provided with respective spaced apertures 3a' and 3b' situated along their lengths. These apertures permit a heating flame 4 to protrude outwardly from the burners to heat a desired area above the burners.

The flame 4 is developed by the burners via igniting a combustible gas which travels through the burners. This gas is supplied to the burners through burner entry ends 3a'' and 3b'' which contain air orifices 3a''' and 3b'''. A gas manifold 5 carries the gas to the entry ends 3a'' and 3b'' and communicates with an exit port 6a of a composite valve 6. The valve 6 includes conventional snap open or slow open gas valves and forms part of an ignition unit 10. It is supplied combustible gas from a gas supply which is not shown.

In addition to the composite valve 6, the ignition unit 10 further comprises a carryover tube 7 which passes adjacent to and crosses each of the burners 3a and 3b. As illustrated, the carryover tube has a first tube section 7a which communicates with a conduit 14 coupled to a second exit port 6b of the composite valve 6. The tube section 7a is generally aligned with the length of the burners 3a and 3b.

A second tube section 7b of the tube 7 extends transverse to the first section 7a and, therefore, transverse to the tubes 3a and 3b. This second section 7b has apertures 7b' which are situated adjacent to the respective rearmost apertures 3a' and 3b', i.e., the apertures closest the entry ends 3a'' and 3b'', of the burners 3a and 3b. The apertures 7b' permit a flame 8 to protrude from the carryover tube into the respective apertures 3a' and 3b' to ignite the gas carried by the burners 3a and 3b, as will be discussed more fully hereinbelow.

A hot surface igniter 9 such as, for example, a silicon carbide igniter, is situated at a first end 7b'' of the carryover tube section 7b. In the case shown, the first end 7b'' of the tube 7b is adjacent to and overlies the burner 3a. This end of the tube section 7b thus contains the aperture 7b'communicating with rearmost aperture 3a' of the burner 3a.

At a second end 7b''' of the carryover tube section 7b, which end is adjacent the burner 3b, a flame sensor 11 is arranged to sense the appearance of the flame 8 at the aperture 7b' at this end of tube. The latter aperture 7b' is adjacent the rearmost aperture 3b' of the burner 3b and, therefore, the sensor 11 senses when the igniting flame 8 becomes available to the rearmost aperture 3b'.

An ignition control 12 controls the actuation of the igniter 9 as well as the action of the composite valve 6. This control operates in accordance with a particular operating sequence and is responsive to the condition (i.e., presence or absence) of the flame at the sensor 11.

More particularly, when the thermostat (not shown) of the furnace 1 signals the ignition control 12 that heating flame is needed, the ignition control initiates the ignition sequence by energizing the igniter 9. This causes sufficient current to flow through the igniter wires 9a to heat the igniter 9 to the ignition temperature of the combustible gas of the system. The ignition control 12 also addresses the composite gas valve 6 causing gas to flow through the exit port 6b into and through the first and second tube sections 7a and 7b of the carryover tube 7.

At the first end 7b'' of the second tube section, the gas in the section is subjected to the heat of the igniter 9 via the aperture 7b' at this end of the tube. Ignition of the gas thereby occurs, causing the flame 8 to appear at the aperture. This ignition continues down the tube section 7b and reaches the second end 7b''', causing flame 8 to also protrude from the aperture 7b' at this end.

The flame sensor 11 thereupon senses the presence of the flame 8 and signals the ignition control 12 via line 11a that flame is present at this location. Upon receiving this signal from the sensor 11, the ignition control 12 then addresses the composite valve 6 causing the valve to now also provide gas to the exit port 6a. This gas travels through the manifold 5 and the burner entry ends 3a'' and 3b'' into and the through the length of the burners.

In passing into the burners 3a and 3b, the gas is exposed to the flame 8 communicating with the rearmost apertures 3a' and 3b' of the burners. This flame causes ignition of the gas and the burners become lit over their lengths. Heating flame 4 thus protrudes from the respective burner apertures 3a', 3b', thereby heating the desired area.

Once the heat from the main burners 3a, 3b causes the thermostat of the furnace 1 to be satisfied, the thermostat signals the ignition control 12 to terminate heating. The control 12 then addresses valve 6 to halt gas presence at the exit ports 6a and 6b. This stops the gas flow to the carryover tube 7 and the main burners 3a and 3b, thereby extinguishing the flames 8 and 4. The aforesaid sequence of operation is then repeated each time the thermostat signals a need for further heating.

Figure 2:
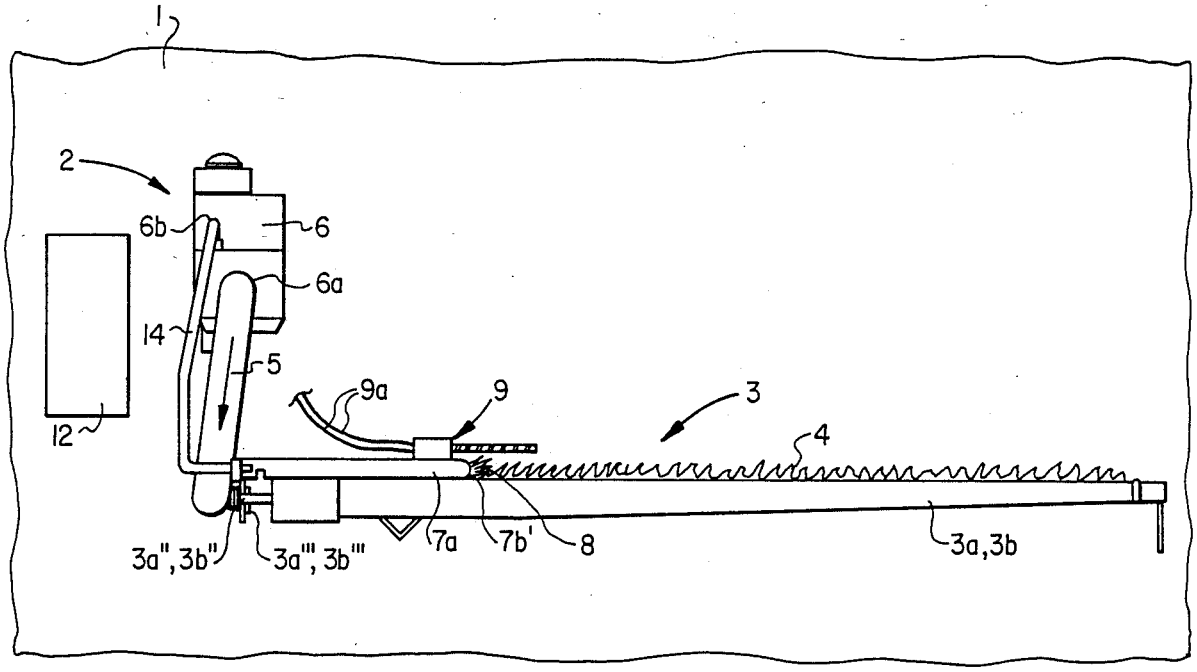
FIG. 2 illustrates, also in schematic, a side view of the apparatus of FIG. 1.

As can be seen from FIGS. 1 and 2, the carryover tube 7 is of much smaller cross section than the main burners 3a, 3b and thus the amount of gas passing through apertures 7b'' of the tube is also relatively small (e.g. the flow through each main burner might between 20,000 to 25,000 BTU/hr as compared to a flow of 2,000 BTU/hr through the carryover tube). As a result, a relatively longer delay (e.g., approximately 60 seconds) can be allowed for the ignition of the carryover tube gas, before the ignition control 12 locks out the ignition sequence.

This long delay easily allows for any changes that might be expected in the characteristics of the hot surface igniter 9. Thus, for example, the expected increase in resistance of the igniter with time, which tends to lengthen the time it takes for the igniter to reach the ignition temperature of the gas, can be substantially accounted for.

The long delay also permits operation of the ignition control 12 such that delivery of gas to the carryover tube 7 by the valve unit 6 is initiated substantially simultaneously with actuation of the igniter. These steps, however, may also be carried out serially, i.e., the igniter 9 can be actuated first and then when the igniter reaches the ignition temperature, the valve unit 6 can be then allowed to provide gas to the carryover tube 7.

Use in the furnace 1 of the combination of the carryover tube 7, the hot surface igniter 9 and the flame sensor 11, provides the furnace 1 with further advantages as compared to the prior furnaces discussed above. In particular, the hot surface igniter has a low susceptibility to misalignment and does not produce a spark, so that the furnace 1 is safer to use as compared prior furnaces employing spark igniters. Also, the presence of the flame sensor for the carryover tube enables the valve 6 to be fabricated from snap open or slow open gas valves, which are less costly and complicated than the step valves employed in prior furnaces. An overall cost effective and reliable furnace results.

It should be appreciated that the ignition control unit 12 can be readily fabricated by a person skilled in the art of furnace design from conventional components adapted to produce the operating sequence and control discussed above.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention. Thus, for example, the main burners 3*a*, 3*b* can take on configurations other than the apertured, tubular configuration shown in FIGS. 1 and 2. In particular, the burners might be formed as so-called "monoport" burners, i.e., short tubular members having gas ports at their ends.

What is claimed is:

1. Gas-fired furnace apparatus comprising:

a mutually spaced plurality of main burner means for receiving throughflows of combustible gas ignitable to create heating flames;

carryover tube means, extending adjacent said plurality of main burner means, for receiving a throughflow of combustible gas ignitable to create a main burner means ignition flame operative to ignite combustible gas flowing through said plurality of main burner means;

hot surface igniter means positioned at a first section of said carryover tube means and operative to ignite at said first section combustible gas flowing into said carryover tube means toward a second section thereof positioned downstream from said first section to create said main burner means ignition flame;

flame sensing means, positioned adjacent said second section of said carryover tube means, for sensing the presence of a portion of said main burner means ignition flame at said second section of said carryover tube means and responsively generating an ignition flame confirmation signal;

valve means for receiving combustible gas from a source thereof, said valve means having a selectively openable first outlet communicating with said carryover tube for operatively flowing a first portion of the received combustible gas into said carryover tube means, and a selectively openable second outlet communicating with said plurality of main burner means for operatively flowing a second portion of the received combustible gas into said plurality of main burner means; and ignition control means for sequentially:

(1) operating said hot surface igniter means and opening said first valve means outlet, in response to a sensed demand for heat from said furnace apparatus, (2) opening said second valve means outlet, in response to the generation of said ignition flame confirmation signals, to create said heating flames, (3) maintaining said first and second valve means outlets in their open positions for the remainder of said sensed demand for heat from said furnace apparatus to thereby maintain each of said ignition and heating flames during said remainder of said sensed demand for heat from said furnace apparatus, and (4) closing each of said first and second valve means outlets, upon cessation of said sensed demand for heat from said furnace apparatus, to thereby extinguish each of said ignition and heating flames.

2. The gas-fired furnace apparatus of claim 1 wherein: said hot surface igniter means comprise a silicon carbide hot surface igniter.

3. The gas-fired furnace apparatus of claim 1 wherein: said ignition control means are operative to simultaneously open said first valve means outlet and energize said hot surface igniter means.

4. The gas-fired furnace apparatus of claim 1 wherein: said ignition control means are operative to energize said hot surface igniter means and then open said first valve means outlet.

5. The gas-fired furnace apparatus of claim 1 wherein: said valve means are of a non-stepped opening type.

6. The gas-fired furnace apparatus of claim 5 wherein: said valve means are of a snap-opening type.

7. The gas-fired furnace apparatus of claim 5 wherein: said valve means are of a slow opening type.

8. The gas-fired furnace apparatus of claim 1 wherein: said carryover tube means have a first aperture in said thereof, and each of said plurality of main burner means includes a generally tubular burner having apertures along its length, said first aperture in said carryover tube means being adjacent an aperture in a first one of said tubular burners, and said second aperture in said carryover tube means being adjacent an aperture in a second one of said tubular burners.

* * * * *

UNITED STATES PATENT AND TRADEMARK OFFICE

CERTIFICATE OF CORRECTION

PATENT NO. : 4,887,959

DATED : December 19, 1989

INVENTOR(S) : Timothy J. Shellenberger

It is certified that error appears in the above-identified patent and that said Letters Patent is hereby corrected as shown below:

Column 4, line 19, "heat" should be --heating--.

Column 6, line 8, "signals" should be --signal--.

Column 6, line 40, after in said insert --first section--.

Signed and Sealed this

Sixteenth Day of July, 1991

*Attest:*

HARRY F. MANBECK, JR.

*Attesting Officer*

*Commissioner of Patents and Trademarks*